United States Patent [19]

Kim

[11] Patent Number: 4,509,631

[45] Date of Patent: Apr. 9, 1985

[54] COIN DOOR ASSEMBLY

[75] Inventor: Syng N. Kim, Hoffman Estates, Ill.

[73] Assignee: Wico Corporation, Niles, Ill.

[21] Appl. No.: 444,530

[22] Filed: Nov. 26, 1982

[51] Int. Cl.[3] ..... G07F 9/10

[52] U.S. Cl. ..... 194/1 A; 40/10 A

[58] Field of Search ..... 194/1 A, 1 B, 1 E, 99, 194/102, 100 R, 100 A, 10; 221/2, 5; 40/10 R, 10 A, 10 C, 325

[56] References Cited

U.S. PATENT DOCUMENTS

| | | | |
|---|---|---|---|
| 1,566,167 | 12/1925 | Petersen et al. | 40/10 A |
| 3,494,454 | 2/1970 | Calgaro et al. | 194/1 B |
| 3,747,733 | 7/1973 | Knickerbocker | 194/10 |
| 4,374,557 | 2/1983 | Sugimoto et al. | 194/100 A |
| 4,377,049 | 3/1983 | Simon et al. | 221/2 |

*Primary Examiner*—Stanley H. Tollberg

*Attorney, Agent, or Firm*—Emrich & Dithmar

[57] ABSTRACT

A coin door assembly includes a door panel with a coin slot therethrough. Mounted on the rear of the panel in spaced-apart relationship are an entry chute communicating with the coin slot and a coin box unit, which cooperate to define therebetween a receptacle for a coin acceptor module. A retainer is mounted on the coin box unit for pivotal movement between open and closed conditions with respect to the receptacle and sliding movement between latched and unlatched positions with respect to the entry chute for cooperation therewith immovably to retain the coin acceptor module in the receptacle. Bearing flanges on the entry chute cooperate with the panel to trap an actuator cam therebetween for pivotal movement to actuate a coin rejection mechanism on the coin acceptor module. A nameplate is removably mounted in a receptacle on the front of the panel.

19 Claims, 9 Drawing Figures

FIG. 6
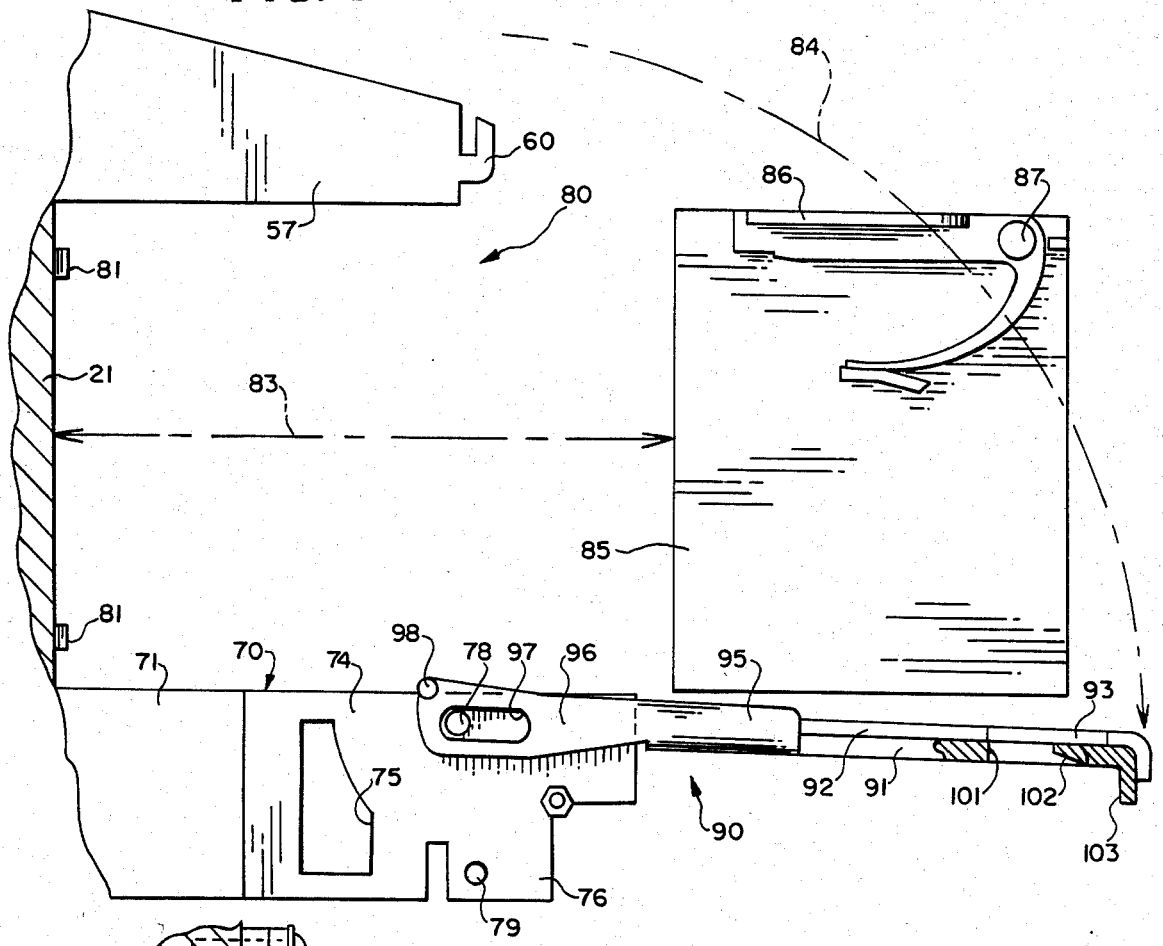
FIG. 7
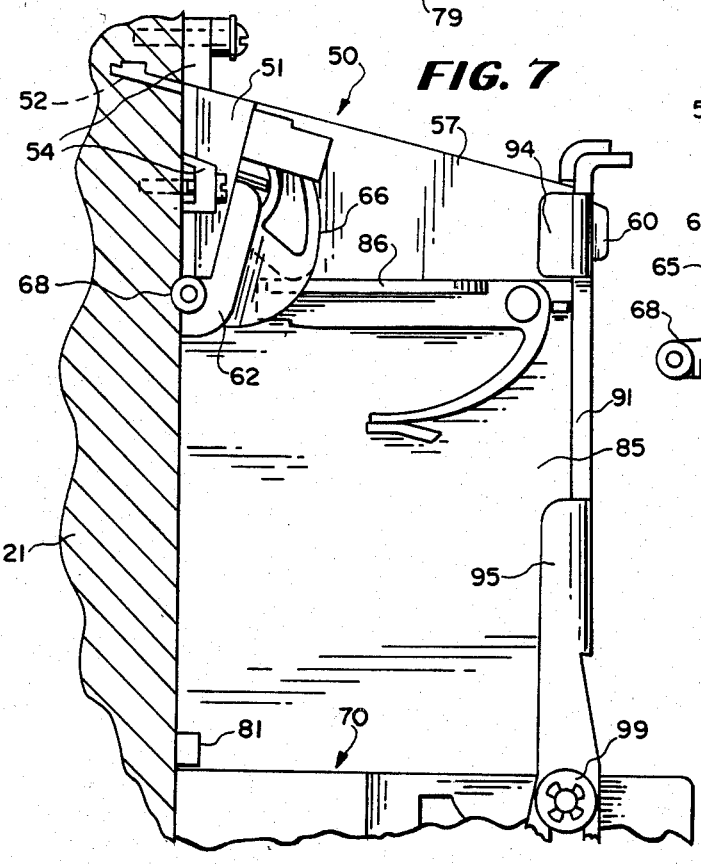
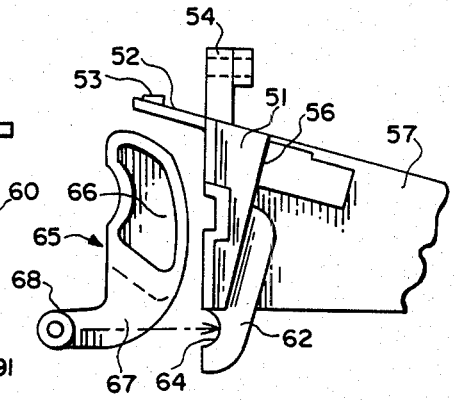
FIG. 8

COIN DOOR ASSEMBLY

BACKGROUND OF THE INVENTION

The present invention relates to coin door assemblies of the type which may be used on coin-operated machines. The present invention is particularly adapted for use on coin-operated arcade games and the like, but it will be appreciated that coin door assemblies of this type may be used on other types of coin-operated equipment, such as vending machines and the like.

Prior coin door assemblies typically include a doorway-defining frame in which is hingedly mounted a door panel, on the rear surface of which is mounted the coin-handling apparatus. This coin-handling apparatus typically includes an entry chute which communicates with a coin-receiving slot in the door panel, and passes the coin to a coin-acceptor device which distinguishes between acceptable and unacceptable coins. Acceptable coins are passed to a coin-collecting vault or other suitable receptacle, while unacceptable coins are held in the acceptor device, which includes a coin rejection mechanism actuated by a cam which is manually-operable by a push button on the door panel, for discharging the rejected coin to a coin-return box accessible to the user from the front of the door panel.

In prior coin door assemblies, the various parts of the coin-handling apparatus are all individually secured by suitable fasteners to the rear surface of the door panel. Thus, the entry chute, the coin-return box, the acceptor device and the rejection actuator cam are all independently fastened to the door panel. This arrangement results in a complicated and time-consuming assembly of the apparatus and further complicates the maintenance thereof. Thus, for example, if it becomes necessary to replace the coin-acceptor device, either because of malfunction or in order to convert the coin door assembly for handling a different denomination coin, the operator must utilize tools to effect the change.

In addition, prior coin door assemblies have included identification nameplates on the front of the door panel to identify either the vendor or owner of the equipment, or possibly other pertinent information such as the identification of the coin-operated device with which the coin door assembly is used. However, these prior coin door assemblies have made no provision for effecting a ready change in the nameplate indicia.

SUMMARY OF THE INVENTION

It is a general object of the present invention to provide an improved coin door assembly which avoids the disadvantages of prior assemblies while affording additional structural and operating advantages.

It is important object of the invention to provide a coin door assembly which minimizes the number of different parts of the coin-handling apparatus independently mounted on the coin door.

In connection with the foregoing object, it is another object of this invention to provide a coin door assembly of the type set forth which permits simple replacement of parts of the coin handling apparatus without the use of tools.

Still another object of this invention is the provision of a coin door assembly which includes removable nameplate means.

Yet another object of this invention is the provision of a coin door assembly which is of simple and economical construction.

These and other objections of the invention are attained by providing a coin receiving assembly including a support panel having a coin receiving opening therein, a coin acceptor module with a coin path therethrough for distinguishing between acceptable and unacceptable coins, and an entry chute mounted on the support panel in communication with the coin receiving opening, the improvement comprising: coin box means having an inlet and mounted on the support panel and cooperating therewith and with the entry chute for defining therebetween a receptacle for the coin acceptor module, the coin acceptor module being freely receivable in the receptacle in a coin accepting position wherein the coin path thereof is disposed in communication with the entry chute and with the inlet of the coin box means, and retaining means adapted for releasably interconnecting the entry chute and the coin box means for cooperation therewith substantially immovably to retain the coin acceptor module in the receptacle.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 6 is a fragmentary side elevational view similar to FIG. 5, with portions of the coin entry mechanism removed, illustrating the retainer in its open condition and the coin acceptor module withdrawn;

FIG. 7 is a view similar to FIG. 6, with the retainer latch closed and illustrating the cooperation of the parts on the door panel;

FIG. 8 is a fragmentary, side-elevational exploded view of the upper left-hand portion of FIG. 7 showing the cooperation between the coin entry unit and the coin rejection actuator.

DESCRIPTION OF THE PREFERRED EMBODIMENT

Figure 1:
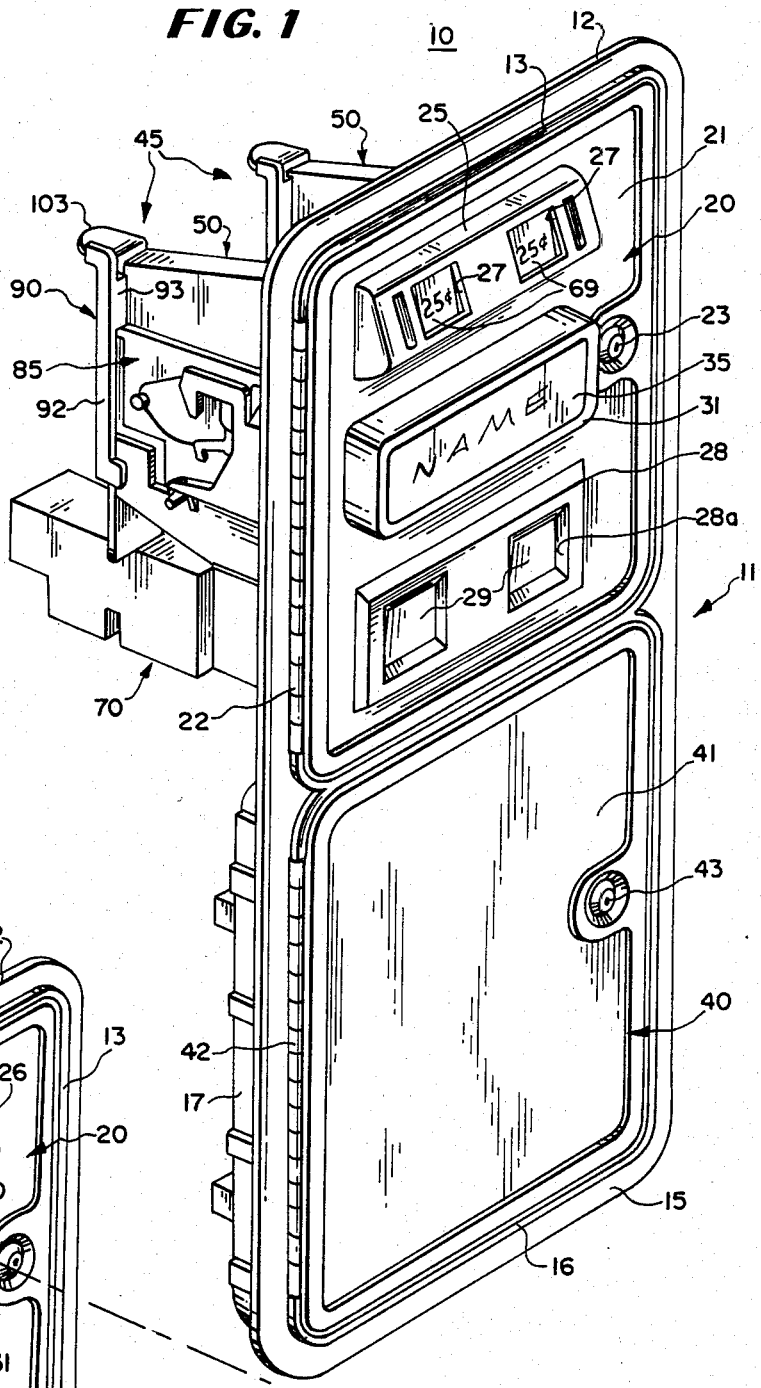
FIG. 1 is a front perspective view of a coin door assembly constructed in accordance with and embodying the features of the present invention.
Figure 2:
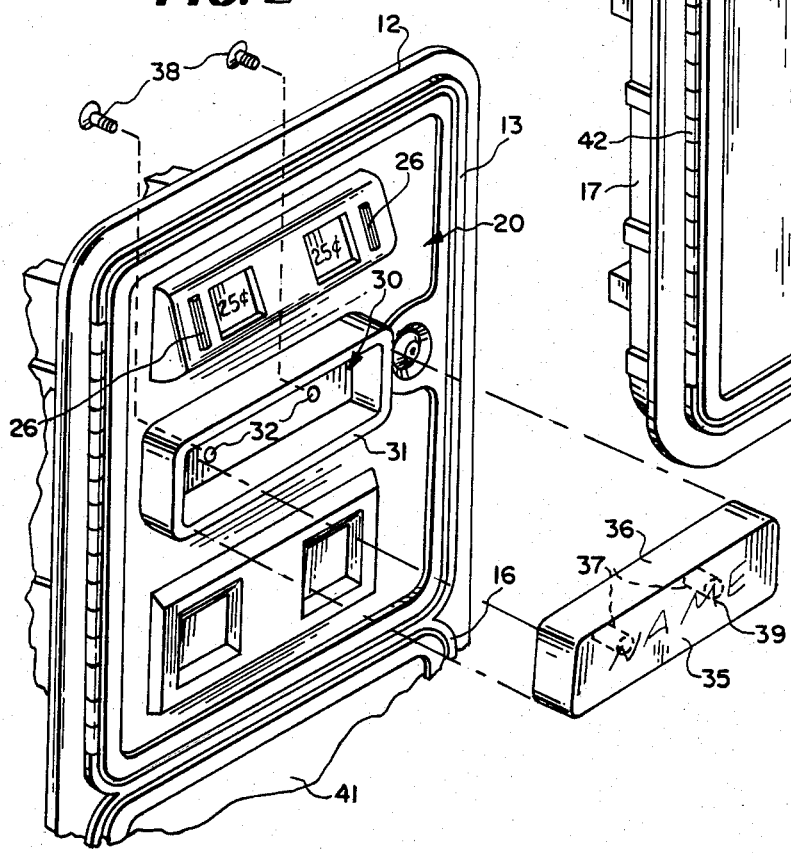
FIG. 2 is a fragmentary perspective view of the upper portion of the coin door assembly of FIG. 1, partially exploded to illustrate the nameplate mounting arrangement.
Figure 3:
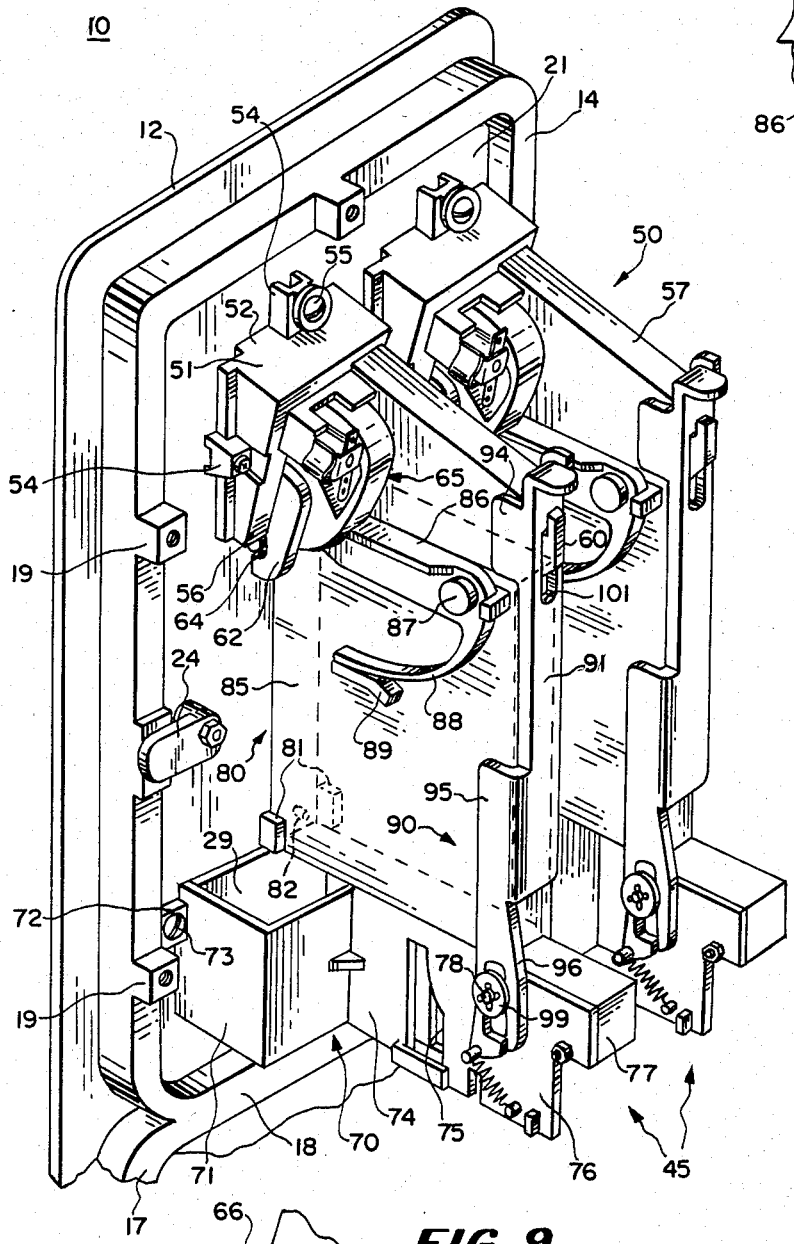
FIG. 3 is an enlarged, fragmentary rear perspective view of the upper portion of the coin door assembly illustrated in FIG. 2.

Referring to FIGS. 1 through 3 of the drawings, there is illustrated a coin door assembly, generally designated by the numeral 10, constructed in accordance with and embodying the features of the present invention. The coin door assembly 10 includes an elongated rectangular frame 11 having an upper rectangular section 12 and a lower rectangular section 15. The upper section 12 is provided with a forwardly projecting peripheral wall 13 and a rearwardly projecting peripheral wall 14 which cooperate to define an upper doorway, while the lower section 15 has a forwardly projecting peripheral wall 16 and a rearwardly projecting peripheral wall 17 which cooperate to define a lower doorway. The rear peripheral walls 14 and 17 join at a common horizontal wall section 18 which separates the upper and lower doorways. The remaining portions of the rear peripheral walls 14 and 17 are provided with internally threaded mounting blocks 19 at spaced-apart points therealong to facilitate fastening the frame 11 to the housing of an associated coin-operated equipment (not shown) such as an arcade game or the like, with which the coin door assembly 10 is to be used.

An upper door 20 is disposed in the upper doorway, the door 20 including a rectangular door panel 21 mounted in the doorway by a piano-type hinge 22 for swinging movement between a closed position illustrated in the drawings, and an open position (not shown) disposed outwardly of the frame 11. The door 20 is provided with a key-operated lock 23 having a latch plate 24 (see FIG. 3) disposed for latching engagement with the rear edge of the peripheral wall 14. Projecting forwardly from the front surface of the panel 21 is a boss 25 which defines a cavity in the rear of the panel 21, the boss 25 having two coin-receiving slots 26 and two rectangular apertures 27 formed therethrough. The lower portion of the panel 21 is provided with a forwardly projecting boss 28 in which are formed two rectangular apertures 28*a*, each closed by a top-hinged, inwardly-swinging flap 29.

The front of the door panel 21 is also provided with a rectangular receptacle, generally designated by the numeral 30, for receiving a nameplate 35. More particularly, the receptacle 30 is defined by a forwardly projecting continuous peripheral wall 31, rectangular in outline. The portion of the panel 21 defining the bottom of the receptacle 30 has two screw holes 32 therethrough. The nameplate 35 is rectangular and is provided with a peripheral wall 36 projecting rearwardly therefrom around the entire perimeter thereof and dimensioned to fit telescopically within the peripheral wall 31. Formed integrally with the inner surface of the nameplate 35 are two rearwardly projecting cylindrical mounting posts 37, each internally threaded for engagement with screws 38 received respectively through the holes 32 securely and removably to mount the nameplate 35 in place in the receptacle 30. Suitable indicia 39 may be embossed on the front surface of the nameplate 35.

The coin door assembly 10 also includes a lower door 40 including a rectangular panel 41 hingedly mounted in the lower doorway by means of a piano-type hinge 42 for swinging movement between a closed position illustrated in the drawings and an open position (not shown) disposed forwardly of the frame 11. The lower door 40 also includes a key-actuated lock 43 which is substantially identical in construction and operation to the lock 23 described above.

Mounted on the rear surface of the upper door 20 are two substantially identical coin-handling apparatuses 45, respectively corresponding to the coin-receiving slots 26. Thus, when the upper door 20 is swung open, the coin-handling apparatuses 45 swing outwardly with it for easy access. In use, coins handled by the coin handling apparatuses 45 are dropped into a coin collecting vault (not shown) disposed therebeneath. This coin vault may be mounted on the associated arcade game or may be mounted on the rear surface of the lower door 40, access to this vault being provided by the lower door 40. While two coin handling apparatuses 45 have been illustrated, it will be appreciated that any desired number of the coin handling apparatuses 45 could be mounted on the upper door 20, depending upon the size thereof and the requirements of the particular game.

Since the coin handling apparatuses 45 are identical, only one will be described in detail. Referring now also to FIGS. 4 through 9 of the drawings, the coin handling apparatus 45 includes a coin entry unit 50 and a coin box unit 70, cooperating to define therebetween a receptacle 80 for a coin acceptor cartridge or module 85, the module 85 being held in place by a retainer 90. The coin entry mechanism 50 includes an open-front entry box 51 which is disposed immediately behind the boss 25, the open front of the entry box 51 communicating with a corresponding one of the coin-receiving slots 26. The upper wall of the entry box 51 is provided with a forwardly projecting rectangular lip 52 (see FIGS. 7 and 8) which projects into the recess defined by the boss 25 and is provided on the upper surface thereof with a pair of spacers 53, accurately to position the entry box 51 with respect to the boss 25. Each of the top and side walls of the entry box 51 is provided with a mounting lug 54 receiving therethrough a screw 55 securely to fasten the coin entry unit 50 in place on the rear of the upper door 20. The entry box 51 has a downwardly and forwardly sloping rear wall 56 having a rectangular aperture (not shown) therein which communicates with an elongated hollow chute 57, generally rectangular in transverse cross section, which is integral with the rear wall 56 and projects rearwardly therefrom. The chute 57 is provided with an outlet opening 58 (see FIG. 4.) in the bottom thereof adjacent to the distal end thereof. The distal end of the chute 57 is closed by a rectangular rear wall 59 having integral therewith a rearwardly-projecting latch hook 60.

Figure 9:
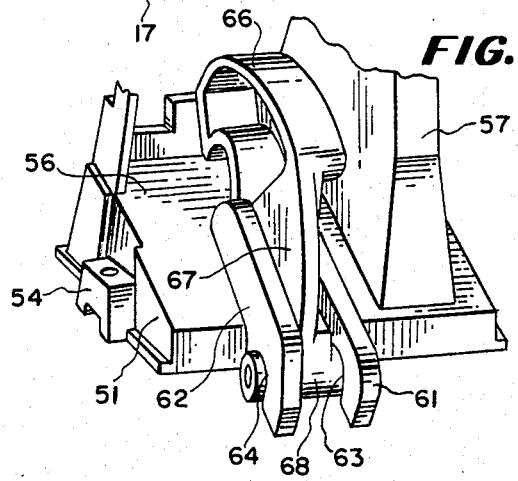
FIG. 9 is an enlarged fragmentary, rear perspective view of the parts illustrated in FIG. 8, shown in their assembled condition.

Also integral with the rear wall 56 and projecting therefrom a predetermined distance below the bottom of the entry box 51 are two laterally spaced-apart, substantially parallel bearing flanges 61 and 62, best illustrated in FIGS. 8 and 9. The front edges of the bearing flanges 61 and 62 are disposed against or very closely adjacent to the rear surface of the door panel 21 when the coin entry unit 50 is mounted in place. The bearing flanges 61 and 62 are respectively provided with arcuate notches 63 and 64 in the front edges thereof, which notches are laterally aligned and cooperate with the door panel 21 to define a generally cylindrical passage. An actuator 65 is carried by the coin entry unit 50, the actuator 65 having a curved cam portion 66 integral at the lower end thereof with a thin forwardly projecting web 67, provided at the distal end thereof with a cylindrical axle 68, the axis of which extends substantially normal to the web 67. The axle 68 is dimensioned to be rotatably received in the passage defined by the notches 63 and 64, with the web 67 being disposed between the bearing flanges 61 and 62 for accommodating pivotal movement of the actuator 65 between a normal rest position, illustrated in the drawings, wherein the actuator 65 bears against the rear wall 56 and an actuating position (not shown) to be described below.

The actuator 65 is operated by a pin (not shown) which extends a through a complementary aperture in the rear wall 56 of the entry box 51, and is secured to a rectangular push button 69 (see FIG. 1) disposed in the corresponding one of the rectangular apertures 27 in the boss 25. Thus, depression of the push button 69 against the urging of a suitable bias spring (not shown), effects pivotal movement of the actuator 65 about the axis of the axle 68 to its actuating position in a known manner.

Figure 4:
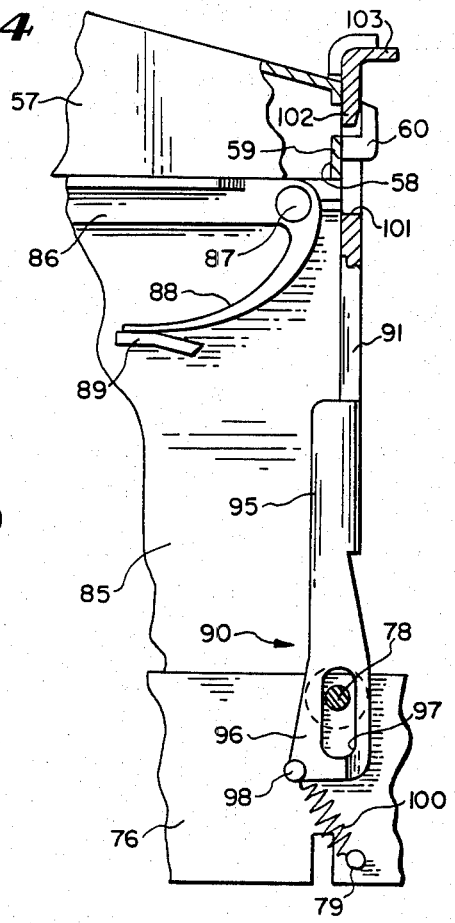
FIG. 4 is a further enlarged, fragmentary side elevational view of one of the coin handling apparatuses of the present invention, as viewed from the left hand side in FIG. 3, with portions broken away more clearly to illustrate the construction, and with the retainer illustrated in its latched position.
Figure 5:
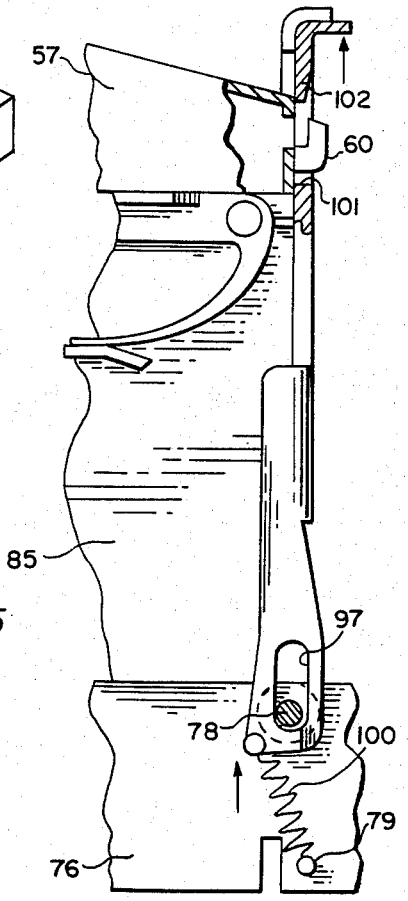
FIG. 5 is a view similar to FIG. 4, illustrating the retainer in its unlatched position.

The coin box unit 70 includes a generally rectangular coin box 71 having an open top and an open front, each of the side and bottom walls of the coin box 71 having an attachment flange 72 (one shown) for receiving a complementary screw 73 securely to fasten the coin box unit 70 to the rear surface of the door panel 21, so that the open front of the coin box 71 communicates with a corresponding one of the apertures 28*a* in the boss 28. Thus, it will be appreciated that the flap 29 serves to close the front of the coin box 71, the coin box 71 being dimensioned to permit inward swinging movement of the flap 29 to provide access to the coin box 71. Integral with the rear wall of the coin box 71 and projecting rearwardly therefrom is a chute 74, generally rectangular in transverse cross section and having a vertical passage therethrough, the side walls of the chute 74 being respectively provided with congruent apertures 75 therein. One of the side walls of the chute 74 projects rearwardly a predetermined distance to form a mounting flange 76, on which may be mounted an electrical switch assembly 77. Integral with the mounting flange 76 and projecting laterally therefrom are two spaced-apart pins 78 and 79 (FIGS. 4–6).

The coin entry unit 50 and the coin box unit 70 are spaced apart along the door panel 21 and cooperate therewith to define a receptacle 80 (see FIG. 6) for accommodating the coin acceptor module 85. The coin acceptor module 85 is in the form of a relatively thin, flat, rectangular cartridge dimensioned to just fit between the coin entry unit 50 and the coin box unit 70. Formed integrally with the rear surface of the door panel 71 at the base of the receptacle 80 are two pairs of positioning lugs 81, the lugs 81 of each pair being spaced apart laterally a distance only slightly greater than the thickness of the coin acceptor module 85 for laterally retaining it in place in the receptacle 80. Additionally, two locating pins 82 (one shown in FIG. 3) project rearwardly from the door panel 21 and are received in complementary openings (not shown) in the coin acceptor module 85 accurately to locate the coin acceptor module 85 in the receptacle 80. The coin acceptor module 85 can be inserted into and removed from the receptacle 80 generally in the direction of the double-ended arrow 83 in FIG. 6.

The coin acceptor module 85 is of standard construction and, therefore, the construction thereof will not be described in detail. Fundamentally, the coin acceptor module 85 serve to distinguish between acceptable and unacceptable coins. This, the coin acceptor module 85 has an inlet at the upper end thereof communicating with the outlet opening 58 of the coin entry unit 50 for receiving coins therefrom. Acceptable coins are passed downwardly through the coin acceptor module 85 and out through an outlet opening at the bottom rear thereof, which communicates with the chute 74 in the coin box unit 70, the accepted coin then passing through the chute 74 to the coin vault. A coin which is of an unacceptable size and weight is held in the coin acceptor module 85 and does not pass to the coin vault. It will be appreciated that a suitable switch (not shown) is provided, for example at the chute 74, for sensing the passage of a coin therethrough to actuate the associated arcade game. Thus, the fact that a coin has not passed the coin acceptor module 85 can be detected by the fact that the associated arcade game is not actuated.

Removal of the unacceptable coin from the coin acceptor module 85 is effected by a rejection mechanism of standard construction, which includes a rejecter lever 86, mounted on the outside of the coin acceptor module 85 for pivotal movement about the axis of a pivot pin 87. The rejector lever 86 is provided with an elongated, flexible, resilient spring leaf 88 (FIG. 3) which is disposed in engagement with a flange 89 on the side wall of the coin acceptor module 85. The spring leaf 88 serves resiliently to bias the rejector lever 86 to a normal position (illustrated in the drawings) in engagement with the cam portion 66 of the actuator 65 (see FIGS. 3 and 7). It can be seen that movement of the actuator 65 pivotally to its actuating position by depression of the push button 69 results in a cammed downward movement of the rejector lever 76 in a counterclockwise direction, as viewed in FIG. 7, to operate the rejection mechanism. This operation serves to release the unacceptable coin from the coin acceptor module 85 and direct it through a second outlet opening at the front of the bottom wall of the coin acceptor module 85 for dropping the coin into the coin box 71 through the open top thereof. Inward movement of the flap 29 then provides access to the coin box 71 for removal of the rejected coin, all in standard fashion.

It is a significant aspect of the present invention that the coin acceptor module 85 is not fixedly secured in the receptacle 80, but is rather loosely deposited therein. The coin acceptor module 85 is held in place in the receptacle 80 by the retainer 90, which includes an elongated, flat, rectangular plate 91 having a width substantially equal to the thickness of the coin acceptor module 85. The plate 91 is provided along one side thereof with an elongated depending side flange 92 (see FIG. 6), the side flange 92 being provided adjacent to one end thereof with a laterally inwardly thickened portion which defines a spacer lug 93. Integral with the other side edge of the plate 91 and depending therefrom opposite the spacer lug 93 is a short rectangular side flange 94 (FIG. 3). Depending from the same side of the plate 91 adjacent to the other end thereof is a side flange 95 which projects downwardly beyond the lower end of the plate 91 to form an extension portion 96. The extension portion 96 has an elongated slot 97 (FIGS. 4–7) therein dimensioned to receive therethrough the pin 78 of the coin box unit 70, the extension portion 96 being secured in place on the pin 78, as by an E-ring 99. A helical tension spring 100 has one end thereof anchored to the pin 79 on the coin box unit 70, and the other end thereof anchored to a pin 98 on the extension portion 96 of the retainer 90.

Thus, it can be seen that the retainer 90 is mounted in place on the coin box unit 70 for pivotal movement, as indicated by the arrow 84 in FIG. 6, between an open condition shown in FIG. 6, accommodating insertion of the coin acceptor module 85 into and removal of it from the receptacle 80, and a closed condition, illustrated in FIG. 7, spanning the receptacle 80 and overlapping the rear distal end of the coin entry unit 50. More specifically, when the retainer 90 is in its closed condition, the side flange 94 and the spacer lug 93 respectively overlap the opposite sides of the coin chute 57 accurately to position the retainer 90, and the side flanges 92 and 95 respectively overlap the side walls of the coin acceptor module 85 to assist in restraining it against lateral movement. The spring 100 serves resiliently to urge the retainer 90 toward its closed condition.

Formed through the plate 91 adjacent to the upper or distal end thereof is a rectangular slot 101 (FIGS. 3–5). Just beyond the upper end of the slot 101 the outer surface of the plate 91 is recessed to define an inclined wedge web 102 (see FIGS. 4–6). Integral with the distal end of the plate 91 and projecting outwardly therefrom substantially normal thereto is a short handle lip 103 to facilitate manipulation of the retainer 90. When the retainer 90 is in its closed condition, it may be pulled upwardly by the use of the handle lip 103, against the urging of the spring 100, to bring the slot 101 into registry with the latch hook 60 on the chute 57. The latch hook 60 is then received through the slot 101 (see FIG. 5) and the retainer 90 is allowed to move back down, under the urging of the spring 100, allowing the hook 60 to ride up onto the wedge web 102 in wedging engagement therewith in a latched position (see FIG. 4) securely latching the retainer 90 in its closed condition.

When the retainer 90 is thus latched in its closed condition it cooperates with the front panel 21, the coin entry unit 50 and the coin box unit 70 substantially immovably to hold the coin acceptor module 85 in place in the receptacle 80. When it is desired to replace move the coin acceptor module 85, the retainer 90 is pulled back up to its unlatched position of FIG. 5 and then swung back to its open condition illustrated in FIG. 6. Thus, it can be seen that the coin acceptor module 85 can easily be mounted in place and removed without the use of tools and yet, in operation, is securely and immovably held in place.

It will also be appreciated that there is effected by the present invention a pivotal mounting of the actuator 65 without the use of separate fastening means therefor.

In a constructional model of the present invention, each of the coin entry unit 50, the actuator 65, the coin box unit 70 and the retainer 90 is of unitary one-piece construction, preferably being molded of a suitable plastic material. Similarly, the coin acceptor module 85 comprises an assembly of molded plastic parts. The nameplate 35 is preferably formed of metal and is also of unitary one-piece construction.

From the foregoing, it can be seen that there has been provided an improved coin door assembly which is of simple and economical construction, characterized by a minimum of fasteners and permitting replacement of certain parts without the use of tools, while also affording an interchangeable nameplate feature.

I claim:

1. In a coin receiving assembly including a support panel having a coin receiving opening therein, a coin acceptor module with a coin path therethrough for distinguishing between acceptable and unacceptable coins, and an entry chute mounted on the support panel and projecting therefrom and in communication with the coin receiving opening, the improvement comprising: coin box means having an inlet and mounted on the support panel, said coin box means being spaced from the entry chute and projecting from the support panel in the same direction as the entry chute and cooperating with the support panel and the entry chute for defining therebetween a receptacle for the coin acceptor module, the coin acceptor module being freely receivable in said receptacle in a coin accepting position wherein the coin path thereof is disposed in communication with the entry chute and with the inlet of said coin box means, and retaining means adapted for releasably interconnecting the entry chute and said coin box means for cooperation therewith substantially immovably to retain the coin acceptor module in said receptacle.

2. The coin receiving assembly of claim 1, wherein said retaining means is mounted on one of the entry chute and said coin box means and is releasably engageable with the other for spanning the space therebetween.

3. The coin receiving assembly of claim 2, wherein said retaining means is mounted on said coin box means.

4. The coin receiving assembly of claim 2, wherein said retaining means is mounted for pivotal movement between an open condition permitting insertion of the coin acceptor module and removal of the coin acceptor module from said receptacle and a closed condition.

5. The coin receiving assembly of claim 4, and further including bias means resiliently urging said retaining means toward the closed condition thereof.

6. The coin receiving assembly of claim 2, and further including mounting means accommodating movement of said retaining means between open and closed conditions with respect to said receptacle, and further including latch means for releasably holding said retaining means in the closed condition thereof.

7. The coin receiving assembly of claim 6, wherein said retaining means includes latch structure thereon, the other one of the entry chute and said coin box means having keeper structure thereon, said latch structure being movable with respect to said keeper structure between latched and unlatched positions.

8. The coin receiving assembly of claim 6, wherein said mounting means accommodates a first type of movement of said retaining means between open and closed conditions with respect to said receptacle and a second type of movement of said retaining means between latched and unlatched positions.

9. The coin receiving assembly of claim 8, wherein said first type of movement is pivotal and said second type of movement is reciprocating.

10. The coin receiving assembly of claim 1, wherein the support panel includes positioning members disposed for engagement with the coin acceptor module in the coin accepting position thereof for preventing lateral movement thereof in said receptacle.

11. The coin receiving assembly of claim 10, wherein said retaining means includes side flanges cooperating with said positioning members for preventing lateral movement of the coin acceptor module in said receptacle.

12. In a coin receiving assembly including a support panel having a coin receiving opening therein, a coin acceptor module carried by the support panel and having a coin path therethrough for distinguishing between acceptable and unacceptable coins and including coin rejection mechanism for controlling the discharge of unacceptable coins therefrom, the improvement comprising: an entry chute mounted on the support panel and providing communication between the coin receiving opening and the coin path of the coin acceptor module, said entry chute having a bearing portion cooperating with the support panel for defining therebetween a bearing passage, and an actuator member disposed in engagement with the coin rejection mechanism and having a cylindrical axle portion rotatably disposed in said bearing passage for pivotal movement of said actuator member about the axis of said axle portion between a normal rest position and an actuating position for actuating the coin rejection mechanism.

13. The receiving assembly of claim 12, wherein said bearing portion and said actuator member include means cooperating effectively to prevent movement of said actuator member axially of said axle portion.

14. The coin receiving assembly of claim 12, wherein said entry chute and said actuator member include means cooperating with the support panel effectively to confine said axle portion in said bearing passage.

15. The coin receiving assembly of claim 12, wherein said bearing portion includes a flange disposed substantially normal to the support panel and having a recess therein facing the support panel for cooperation therewith to define said bearing passage.

16. The coin receiving assembly of claim 12, wherein said bearing portion includes two spaced-apart parallel flanges disposed substantially normal to the support panel and respectively having aligned recesses therein facing the support panel for cooperation therewith to define said bearing passage, said actuator member having a mounting web disposed between said flanges, said axle portion being carried by said mounting web.

17. In a coin receiving assembly including a support panel having a coin receiving opening therein, and coin handling mechanism mounted on the rear surface of the support panel and communicating with the coin receiving opening, the improvement comprising: a continuous wall unitary with the front surface of the support panel and projecting forwardly therefrom substantially normal thereto for cooperation therewith to define a receptacle, a nameplate receivable in said receptacle and having a rear side facing the support panel and a front side exposed to view, and attachment means engageable with said nameplate along only said rear side thereof, said attachment means being the sole means for removably fastening said nameplate in said receptacle.

18. The coin receiving assembly of claim 17, wherein said nameplate has a peripheral flange projecting rearwardly therefrom around the entire perimeter thereof and adapted to be received within said wall in telescoping relationship therewith.

19. The coin receiving assembly of claim 17, wherein said attachment means includes threaded fastening means engageable only with the rear of said nameplate for removably mounting said nameplate in said receptacle.

* * * * *